US010302038B2

(12) United States Patent
Mishra et al.

(10) Patent No.: US 10,302,038 B2
(45) Date of Patent: May 28, 2019

(54) REGULATION OF FUEL RAIL PRESSURE USING ELECTRONIC FUEL TRANSFER PUMP IN LOW PRESSURE FUEL CIRCUITS

(71) Applicant: CUMMINS INC., Columbus, IN (US)

(72) Inventors: Shounak Mishra, Columbus, IN (US); Norman C. Blizard, Columbus, IN (US); Edward Nathan Linen, Columbus, IN (US); Joseph Andrew Worthington, Scipio, IN (US)

(73) Assignee: Cummins Inc., Columbus, IN (US)

( * ) Notice: Subject to any disclaimer, the term of this patent is extended or adjusted under 35 U.S.C. 154(b) by 76 days.

(21) Appl. No.: 15/292,849

(22) Filed: Oct. 13, 2016

(65) Prior Publication Data

US 2017/0101959 A1 Apr. 13, 2017

Related U.S. Application Data

(60) Provisional application No. 62/240,802, filed on Oct. 13, 2015.

(51) Int. Cl.

| | |
|---|---|
| ***F02D 41/30*** | (2006.01) |
| ***F02M 37/08*** | (2006.01) |
| ***F02M 37/18*** | (2006.01) |
| ***F02D 41/38*** | (2006.01) |
| ***F02D 41/22*** | (2006.01) |

(52) U.S. Cl.

CPC ..... *F02D 41/3082* (2013.01); *F02D 41/221* (2013.01); *F02D 41/3854* (2013.01); *F02M 37/08* (2013.01); *F02M 37/18* (2013.01); *F02D 2041/223* (2013.01)

(58) Field of Classification Search

CPC .... F02D 33/003; F02D 41/221; F02D 41/222; F02D 41/3082; F02D 41/3809; F02D 2041/224; F02D 2200/06; F02D 2250/31; F02M 37/08; F02M 37/18; F02M 65/002

See application file for complete search history.

(56) References Cited

U.S. PATENT DOCUMENTS 5,937,826 A * 8/1999 Olson ..... F02D 41/221 123/198 D
6,125,822 A * 10/2000 Janik ..... F02M 55/00 123/457
6,446,613 B1 * 9/2002 Djordjevic ..... F02M 63/005 123/456

(Continued)

*Primary Examiner* — Erick R Solis
*Assistant Examiner* — Anthony L Bacon
(74) *Attorney, Agent, or Firm* — Faegre Baker Daniels LLP

(57) ABSTRACT

Systems and related methods for regulating fuel rail pressure for internal combustion engines utilizing an electronic fuel transfer pump (eFTP) on the low side to provide robust control of fuel pressure on the high side. The eFTP is in fluid communication with a low-pressure fuel circuit for providing a low-pressure fuel flow at a low pressure to a high-pressure pump. Upon failure of a fuel control valve, a pressure-responsive valve, and/or a pressure sensor impacting the high-side fuel pressure, the eFTP modulates the low-side fuel flow and/or low-side fuel pressure to mitigate damage to the engine. A controller in operative communication with the eFTP and/or one or more sensors is configured to provide a pump command to the eFTP in response to a failure condition impacting the high-side fuel pressure.

21 Claims, 5 Drawing Sheets

(56) References Cited

U.S. PATENT DOCUMENTS

| | | | | |
|---|---|---|---|---|
| 9,835,121 | B2 * | 12/2017 | Tagawa | F02M 37/08 |
| 2002/0088437 | A1 * | 7/2002 | Ricco | F02B 67/00 123/457 |
| 2005/0199219 | A1 * | 9/2005 | Utsumi | F02D 41/22 123/458 |
| 2006/0144130 | A1 * | 7/2006 | Eser | F02D 41/221 73/114.43 |
| 2010/0282212 | A1 * | 11/2010 | Shafer | F02D 41/3863 123/456 |
| 2012/0080010 | A1 * | 4/2012 | Nistler | F02D 41/3863 123/456 |
| 2013/0144507 | A1 * | 6/2013 | Lee | F02D 41/3082 701/103 |
| 2014/0053812 | A1 * | 2/2014 | Kojima | F02M 63/0245 123/457 |
| 2014/0165970 | A1 * | 6/2014 | Lee | F02D 41/221 123/495 |
| 2015/0167579 | A1 * | 6/2015 | Koo | F02D 41/221 123/294 |
| 2016/0319784 | A1 * | 11/2016 | Yamada | F02D 41/3082 |

* cited by examiner

FIGURE 2 – PRIOR ART

REGULATION OF FUEL RAIL PRESSURE USING ELECTRONIC FUEL TRANSFER PUMP IN LOW PRESSURE FUEL CIRCUITS

PRIORITY CLAIM

This application claims priority to U.S. 62/240,802 filed on Oct. 13, 2015, the entire disclosure of which is hereby expressly incorporated by reference herein.

FIELD OF THE DISCLOSURE

The present disclosure generally relates to methods and systems for regulating fuel rail pressure for engines and, more particularly, to regulating fuel rail pressure using an electronic fuel transfer pump to provide robust control of rail pressure in a modular common rail system.

BACKGROUND OF THE DISCLOSURE

Conventional fuel system architectures for internal combustion engines sometimes employ a common rail system, which typically requires highly pressurized fuel to be provided to fuel injectors. Such common rail systems often include a low-pressure fuel circuit that provides fuel flow to a high-pressure fuel pump and a high-pressure fuel circuit, which includes the fuel rail and feeds the injectors. In some cases, fuel in the low-pressure fuel circuit is pressurized above atmospheric pressure, 5-6 bar for example, and then the high-pressure fuel pump further pressurizes the fuel to an appropriate high fuel pressure that may be two to three orders of magnitude higher than the low-side fuel pressure (above 1600 bar in heavy duty systems for example) in the fuel rail to facilitate efficient and effective fuel injection for combustion.

Various components facilitate the delivery of low-pressure fuel to the inlet of the high-pressure fuel pump. A combination of a fuel priming pump and a crank driven mechanical gear pump in the low-pressure circuit is utilized in some conventional fuel systems to create the required level of fuel pressure at the inlet of the high-pressure pump. Some systems utilize an electronically controlled fuel transfer pump (eFTP) on low-pressure fuel circuits as an option. However, such conventional fuel system and eFTP systems have not been demonstrated for effective and robust operation.

Various components facilitate the regulation of pressure in the fuel rail. A fuel control valve is often utilized in conventional fuel systems to modulate the fuel flow to the high-pressure pump. In some such systems, the fuel control valve opens or closes in response to pressure in the fuel rail, measured by a pressure sensor, in order to regulate the fuel rail pressure toward an appropriate high fuel pressure. Further, in some systems, a mechanical, pressure-responsive valve (e.g., a pressure-regulating valve or a pressure-relief valve) allows excess fuel pressure above the appropriate pressure to bleed off fuel back to the fuel tank by opening when the pressure exceeds a threshold pressure and/or by regulating pressure toward an appropriate value.

Common failures in such conventional fuel systems include failure of the fuel control valve, failure of the pressure sensor, and/or failure of the pressure-responsive valve. The failure of one or more of these components often results in at least a partial loss of the ability to regulate the fuel rail pressure and thus the effectiveness of injection. Losing the ability to regulate can have undesirable consequences: greater emissions of in-cylinder particulate matter or nitrous oxides ($NO_X$), reduced fuel efficiency (e.g., increase fuel consumption), and/or reduced service life of fuel system components (e.g., accelerated wear and tear damage).

Some conventional fuel systems are designed to substantially, or even severely, derate the engine in response to such failures (e.g., artificially limit torque or power output), with the purpose of mitigating the undesirable effects of the failure. However, derating the engine compromises the engine's performance and often causes noticeable problems for users—such as in on-road applications, wherein an engine fails with the nearest service center being hundreds of miles away, and in off-road applications, wherein an engine failure causes undesirable downtime or unacceptable performance until serviced.

BRIEF DESCRIPTION OF THE DRAWINGS

The above-mentioned and other features and advantages of this disclosure, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate exemplary embodiments of the invention and such exemplifications are not to be construed as limiting the scope of the invention in any manner.

DETAILED DESCRIPTION

Figure 1:
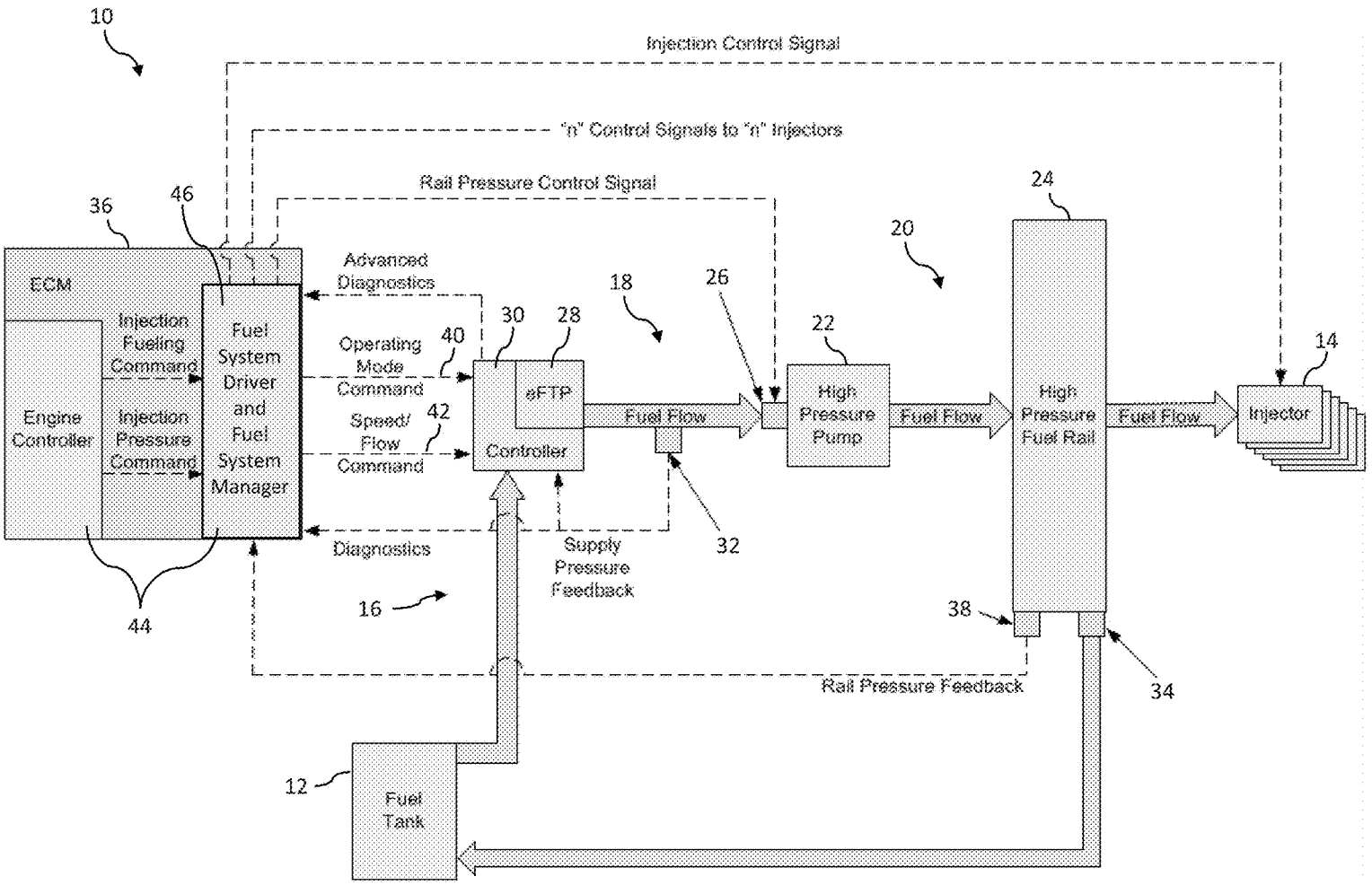
FIG. 1 is a schematic illustration of a fuel system, according to some embodiments.

Referring initially to FIG. 1, a fuel system 10 is shown wherein fuel is supplied from a fuel source 12 (e.g., fuel tank) to a plurality of fuel injectors 14 along a fuel flow path 16. The fuel system 10 is suited for use with an internal combustion engine having one or more cylinders for combustion. As used herein, "upstream" refers to a direction along the fuel flow path 16 toward to the fuel source 12, and "downstream" refers to a direction along the fuel flow path 16 toward the fuel injectors 14.

The fuel flow path 16 includes a low-pressure (LP) fuel circuit 18 in fluid communication with the fuel source 12, a high-pressure (HP) fuel circuit 20 positioned downstream from the LP fuel circuit 18 and in fluid communication with the fuel injectors 14, and an HP pump 22 including an inlet and an outlet between the LP fuel circuit 18 and the HP fuel circuit 20. In operation, the HP pump 22 pumps fuel from the LP fuel circuit 18 to the HP fuel circuit 20. In particular, for example, an LP fuel flow in the LP fuel circuit 18 available at the inlet of the HP pump 22 is pressurized and pumped to the HP fuel circuit 20 as an HP fuel flow via the outlet of the HP pump. In some embodiments, the HP pump 22 is mechanically driven proportional to engine speed (e.g., by the crankshaft).

As used herein, the "high side" of the fuel system 10 refers to the portion of the fuel flow path 16 downstream of the HP pump 22 (e.g., the HP fuel circuit 20), and the "low side" refers to the portion of the fuel flow path upstream of the HP pump 22 (e.g., the LP fuel circuit 18).

The HP fuel circuit 20 includes an HP fuel rail 24 that serves as a reservoir of pressurized fuel. The HP fuel rail 24 is positioned between the HP pump 22 and the fuel injectors 14 along the fuel flow path 16. In operation, the fuel injectors 14 open to inject pressurized fuel into the engine cylinders. In some embodiments, the volume of the HP fuel circuit 20, including the HP fuel rail 24, is substantially smaller than the volume of the LP fuel circuit 18. In operation, due to the inversely proportional relationship between pressure and volume of an amount of fluid (e.g., fuel), the HP pump 22 is configured to provide the pressurized HP fuel flow by delivering the LP fuel flow into the smaller volume of the HP fuel rail 24.

Accordingly, the pressure of the LP fuel flow at the inlet of the HP pump 22 impacts the amount of fuel that the HP pump 22 has to pressurize, and so the pressure of the LP fuel flow, or low-side fuel pressure, proportionally impacts the pressure of the HP fuel flow, or high-side fuel pressure. In some embodiments, the ability of the HP pump 22 to provide a regulated high-side fuel pressure depends on the low-side fuel pressure to be at or near a target low-side fuel pressure; otherwise, the HP pump 22 does not reliably provide a high-side fuel pressure appropriate for fuel delivery. In some embodiments, the HP pump 22 is not capable of modulating the high-side fuel pressure independently from the low-side fuel pressure.

In various embodiments, the HP pump 22 is configured with an appropriate or target fuel pressure at the outlet for provision to the HP fuel circuit 20 and the HP fuel rail 24. In some embodiments, the high-side fuel pressure is about two to three orders of magnitude higher than the low-side fuel pressure (e.g., above about 1600 bar) during operation. In further or alternative embodiments, the HP pump 22 has a minimum fuel pressure at the inlet, below which the HP pump 22 cannot provide the appropriate or target fuel pressure at the outlet. A minimum fuel pressure is less than about 6 bar.

A fuel control valve (FCV) 26 facilitates the regulation of the fuel pressure in the fuel rail 24. The FCV 26 is positioned on the low side, upstream from the HP pump 22, and along the LP fuel circuit 18. In some embodiments, the FCV 26 is positioned at or near the inlet of the HP pump 22. The FCV 26 opens and closes to modulate the flow of fuel. In operation, the FCV 26 opens and closes to modulate the LP fuel flow into the inlet of the HP pump 22, thereby impacting the amount of fuel that the HP pump 22 has to pressurize and the pressure of the HP fuel flow.

In various other embodiments, the FCV 26 is considered part of the HP pump 22, allowing the HP pump 22 to modulate the amount of fuel flow available for pressurization and thus the high-side fuel pressure.

An electronic fuel transfer pump (eFTP) 28 pumps fuel from the fuel source 12 to the LP fuel circuit 18. The eFTP 28 is positioned along the LP fuel circuit 18 between the fuel source 12 and the FCV 26 and/or HP pump 22. In some embodiments, the eFTP 28 has an inlet in fluid communication with the fuel source 12 and an outlet in fluid communication with the LP fuel circuit 18. In operation, an example fuel pressure at the fuel source 12 is about 1 bar (or about 1 atm), and an example low-side fuel pressure is about 6 bar. Any suitable eFTP may be used for eFTP 28, such as the eFTP described in U.S. Pat. No. 8,844,503, filed on Sep. 23, 2011 and titled VARIABLE FLOW FUEL TRANSFER PUMP SYSTEM AND METHOD, which is expressly incorporated by reference herein for all purposes.

The eFTP 28 is configured to modulate the LP fuel flow, which proportionally affects the low-side fuel pressure and, thus, may proportionally impact the high-side fuel pressure. In some embodiments, the eFTP 28 includes means to receive information, to determine parameters, and/or to direct operation of the eFTP 28 functionality. As shown, the eFTP 28 includes an eFTP controller 30 as an example of such means.

A low-side pressure sensor 32 measures the low-side fuel pressure. The low-side pressure sensor 32 is positioned along the LP fuel circuit 18 between the eFTP 28 and the FCV 26 and/or HP pump 22. In some embodiments, the low-side pressure sensor 32 provides a low-side pressure value indicating the pressure measured in the LP fuel circuit 18.

In various embodiments, the eFTP 28 regulates the low-side fuel pressure during operation. The low-side fuel pressure, for example, may be disturbed by the flow of fuel from the fuel source 12 or the ambient temperature. The eFTP 28 is configured or calibrated to regulate the low-side fuel pressure toward a low-side pressure target (e.g., about 6 bar) to compensate for such disturbances. In the illustrated embodiment, for example, the eFTP 28 and the low-side pressure sensor 32 are in operative communication, and the eFTP controller 30 is configured to receive a low-side pressure value provided by the low-side pressure sensor 32. In response to the low-side pressure value and the low-side pressure target, the eFTP controller 30 determines a regulated fuel flow value for operating the eFTP 28 to regulate the low-side fuel pressure toward the low-side pressure target. Because the low-side fuel pressure may proportionally impact the high-side fuel pressure, the eFTP 28 also affects the high-side fuel pressure.

A pressure-responsive valve (PRV) 34 relieves or regulates pressure in the HP fuel circuit 20. Non-limiting examples of a PRV include a pressure-regulating valve and a pressure-relief valve. As shown, the PRV 34 is positioned between and is in fluid communication with the fuel source 12 and fuel rail 24.

The PRV 34 relieves excess pressure in the HP fuel circuit 20 to protect engine components and facilitate engine servicing. In some cases, the PRV 34 is a two-stage relief valve that opens at a tripping pressure to relieve excess pressure in a first stage and regulates the high-side fuel pressure to a protective pressure in a second stage. However, other suitable valves are also contemplated. The PRV 34 is a mechanical, two-stage relief valve including a spring biased against the high-side fuel flow and a tip that, when seated, closes the PRV 34.

Excess high-side fuel pressure may damage engine components during engine operation over time. In various embodiments, the PRV 34 responds to a tripping pressure higher than the nominal high-side fuel pressure, which may indicate a failure impairing the ability of the fuel system 10 to otherwise regulate the high-side fuel pressure. An example tripping pressure is about 20% higher. The tripping pressure is sufficient to unseat the PRV tip, thereby opening the PRV 34 and allowing fuel to flow therethrough in the PRV first stage. As shown, the PRV 34 bleeds excess fuel pressure and fuel back to the fuel source 12.

Such failures may also indicate that engine service is needed. In some embodiments, the PRV 34 further responds to the tripping pressure, in the PRV second stage, by remaining open to bleed the high-side fuel pressure to a protective pressure lower than the nominal high-side fuel pressure. In various cases, the biasing force of the PRV spring is balanced with the tripping pressure and corresponding fuel flow. For example, the PRV 34 remains open as long as the high-side fuel flow through the open PRV 34 is sufficient to overcome the biasing force of the PRV spring, which keeps the PRV tip unseated (e.g., the HP pump 22 is providing sufficient fuel flow to the HP fuel circuit 20). An example protective pressure is 40% of the nominal high-side fuel pressure, which facilitates a suitable environment for servicing. The PRV 34 resets to a closed position once the high-side fuel pressure drops below the tripping pressure.

Various components described herein throughout, such as the FCV 26, eFTP 28, and PRV 34, are capable of individually and/or cooperatively regulating the low-side and/or high-side fuel pressure. A controller 36, such as an engine control module (ECM), is configured to facilitate the regulation of the high-side fuel pressure, for example, by managing operation of at least one of the FCV 26 and the eFTP 28. As shown, the controller 36 is in operative communication the FCV 26, eFTP 28 including the controller 30, low-side pressure sensor 32, and a high-side pressure sensor 38.

The high-side pressure sensor 38 measures the high-side fuel pressure. The high-side pressure sensor 38 is positioned along the HP fuel circuit 20 between the HP pump 22 and the fuel injectors 14. In some embodiments, the high-side pressure sensor 38 provides a high-side pressure value indicating the pressure measured in the HP fuel circuit 20, including the HP fuel rail 24.

In various embodiments, the controller 36 selectively provides one or more commands to the eFTP 28. Non-limiting examples of commands include an operating mode command 40 and/or a pump command 42. The controller 36 provides an operating mode command 40 to turn ON or turn OFF the eFTP 28 (e.g., activate or deactivate). The pump command 42 is provided by the controller 36 to the eFTP 28 to regulate the low-side fuel flow toward an appropriate or target low-side fuel flow, for example. Non-limiting examples of the pump command 42 include one or more of a fuel flow command, a pump speed command, and a low-side fuel pressure command. In response to the pump command 42, which may include target values, the eFTP 28 operates to achieve the selected pump target.

In some embodiments, the controller 36 regulates the high-side fuel pressure during operation. The high-side fuel pressure, for example, may be measured by the high-side pressure sensor 38 fluidly coupled to the HP fuel rail 24. The controller 36 interprets a high-side fuel pressure value in response to a measurement of the high-side pressure sensor 38. In response to the high-side fuel pressure value, the controller 36 determines an appropriate or target low-side fuel flow. The appropriate or target low-side fuel flow is selected to regulate the high-side fuel pressure toward an appropriate or target high-side fuel pressure.

In additional or alternative embodiments, the low-pressure fuel flow into the inlet of the HP pump 22 is regulated by cooperative operation of the FCV 26 and the eFTP 28, which may be controlled or coordinated by the controller 36. In some such cases, the FCV 26 is the primary actuator for regulation of the fuel flow, and the eFTP 28 is the secondary actuator for regulation. However, other cooperative control schemes are also contemplated. The FCV 26 is positioned at, or directly upstream of, the inlet of the HP pump 22, making the FCV 26 well-suited for direct control of fuel flow into the HP pump 22 as a primary actuator. In some embodiments (e.g., FIG. 3), the LP fuel circuit 18 includes a fuel filter system downstream of the eFTP 28 and upstream of the FCV 26. During operation, fuel filters may accumulate particulate build-up and change the fuel flow in the LP fuel circuit 18 downstream of the eFTP 28 before reaching the HP pump 22, which may limit the ability of the eFTP to directly or precisely control the low-pressure fuel flow provided to the HP pump 22, even with a low-side pressure sensor 32.

The controller 36 is configured to monitor the condition of the HP fuel circuit 20 over a period of time. For example, over time, the controller 36 iteratively or continually measures the high-side fuel pressure via the high-side pressure sensor 38. In some embodiments, the controller 36 determines that the high-side fuel pressure has deviated from an appropriate or target high-side fuel pressure. In various embodiments, the controller 36 detects whether there is a failure condition in the fuel system 10 that affects the high-side fuel pressure, which may be detrimental to engine operation.

Non-limiting examples of such failures in the fuel system 10 include failure in the electrical connections between the controller 36 and the FCV 26 (e.g., typically failing to an open state of the FCV), tripping or failure of a mechanical PRV 34, failure of the HP pump 22, and/or losing a high-side pressure value from the high-side pressure sensor 38 (e.g., sensor failure or wiring failure). When the FCV 26 or PRV 34 fail to an open state, for example, the high-side fuel pressure in the HP fuel rail 24 increases above the appropriate or target high-side fuel pressure. When the PRV 34 is tripped, for example, the high-side fuel pressure in the HP fuel circuit 20 drops below the appropriate or target high-side fuel pressure. When the high-side pressure sensor 38 fails, for example, the controller 36 is unable to provide a command to the FCV 26 to regulate the high-side fuel pressure in response to a high-side fuel pressure measurement.

In some embodiments, the controller 36 is capable of detecting which component has failed by a diagnostic process, such as a process of elimination. The controller 36 has control of and can modulate the FCV 26 and receives feedback from the high-side pressure sensor 38 during operation. In one case, should the high-side pressure sensor 38 measure an increased high-side pressure and modulation of the FCV 26 is ineffective in reducing the high-side pressure, the controller 36 can detect or determine that the FCV 26 has failed. In a further case, should the high-side pressure sensor 38 measurement provide uncharacteristic values and/or provide values deviating from expected high-side pressure values corresponding to modulations of the FCV 26, the controller 36 can detect or determine that the high-side pressure sensor 38 has failed or the PRV 34 has tripped. In another case, should the high-side pressure sensor 38 measure a high-side fuel pressure deviating from a target high-side fuel pressure corresponding to cooperative modulations of the FCV 26 and the eFTP 28, the controller 36 can detect or determine that the PRV 34 or HP pump 22 has failed, for example. In such cases where a PRV 34 or HP pump 22 has failed, the controller 36 optionally detects oscillations in the high-side fuel pressure (e.g., similar to the effect of "water hammer") due to the imbalance between the defective PRV spring and the high-side fuel flow and/or pressure provided by the HP pump 22.

In various embodiments, the controller 36 is capable of diagnosing the particular failure causing the high-side fuel pressure deviation. In response to detecting the determined failure and/or deviation, the controller 36 provides the pump command 42 indicative of the appropriate or target low-side fuel flow to regulate the high-side fuel pressure.

In some cases, the low-side and/or the high-side fuel flow and/or pressure are able to be regulated to appropriate or target values during nominal operation (e.g., in the absence of a failure). However, in other cases, wherein fuel flows and/or fuel pressures are incapable of being regulated toward nominal target values, these parameters are regulated toward appropriate or target values to mitigate damage to the engine while balancing performance needs of the user in the particular application. In some embodiments, the engine is intentionally derated in torque or speed to protect the engine in response to the detection of a failure condition and/or a determination that the fuel flow/pressure cannot support the demanded power output. In some embodiments, when the engine speed is intentionally derated, the HP pump 22 also slows down, and in response, the eFTP 28 and optionally the FCV 26 are commanded by the controller 36 to decrease the fuel flow into the HP pump 22 to compensate for the reduced fuel consumption.

In various embodiments, with the capability to modulate the low-side fuel flow and/or fuel pressure, particularly via the eFTP 28, the magnitude of engine derating can be reduced, thereby improving performance, in comparison to the magnitude of engine derating performed in conventional fuel system architectures. For example, when the HP pump 22 fails and slows down or loses power, and the engine power is not intentionally derated, the eFTP 28 is commanded by the controller 36 to increase the low-side fuel pressure to mitigate the loss in the HP pump power. When the FCV 26 fails to open, for example, the eFTP 28 is commanded by the controller 36 to reduce the low-side fuel flow to mitigate the increase in high-side fuel pressure. When the PRV 34 or HP pump 22 fails, for example, eFTP 28 is commanded by the controller 36 to modulate the low-side fuel flow to mitigate the disturbance in high-side fuel flow. When the high-side pressure sensor 38 fails, for example, the eFTP 28 is commanded by the controller 36 to provide a predetermined or calibrated low-side fuel flow and/or fuel pressure to regulate the high-side fuel pressure, at least in feed-forward control, in response to other engine parameters (e.g., engine speed and/or temperature) without feedback information about the high-side fuel pressure.

In some embodiments, in response to the pump command 42, the eFTP 28 regulates the low-side fuel flow toward the appropriate or target low-side fuel flow determined by the controller 36. Furthermore, the eFTP 28 including the eFTP controller 30 regulates the low-side fuel pressure toward an appropriate or target low-side fuel flow. In this manner, an appropriate or target fuel flow and an appropriate or target fuel pressure are delivered to the inlet of the HP pump 22.

By providing such redundant control as described herein throughout, an effective and robust fuel system 10 is provided capable of regulating low-side and high-side fuel pressure independent of engine speed upon failure of the FCV 26, the PRV 34, and/or the high-side pressure sensor 38, which facilitates the reduction of in-cylinder particulate matter and/or nitrous oxides ($NO_X$), as well as the improvement of fuel consumption, when delivering fuel through the fuel injectors 14 to the cylinders for combustion.

In the illustrated embodiment, the controller 36 is in operative communication with one or more other components of the fuel system 10 to monitor and/or provide commands to such components and to facilitate the regulation of the fuel pressure. As shown, the eFTP 28 is operatively coupled to communicate diagnostic (e.g., advanced diagnostics) data to the controller 36, to receive an operating mode command 40, and to receive a pump command 42. Also, as shown, the controller 36 is operatively coupled to the high-side pressure sensor 38 to receive a high-side fuel pressure value and/or a condition of the high-side fuel pressure sensor 38, to the FCV 26 to provide a rail pressure control signal and/or receive a condition of the FCV 26, to the low-side pressure sensor 32 to receive diagnostics regarding the condition of the low-side pressure sensor 32, and to the fuel injectors 14 to provide a fuel injection command.

The controllers 30, 36 perform certain operations to control one or more components of the engine system, including the fuel system 10. In certain embodiments, the controllers 30, 36 form a portion of a processing subsystem including one or more computing devices having memory, processing, and communication hardware. The controllers 30, 36 may be single devices or distributed devices, and the functions of the controllers may be performed by hardware and/or as computer instructions on a non-transient computer readable storage medium.

The logical relationship among the controllers 30, 36 and their functionality may be implemented in any known manner. Controller 30 is shown as separate from controller 36 in FIG. 1. However, controller 36 may alternatively be implemented as part of controller 30, or vice versa. For example, the controllers 30, 36 may be implemented in a single physical device, or in another example, as a distributed device.

In certain embodiments, the controllers 30, 36 include one or more definers, determiners, evaluators, drivers, and/or regulators that functionally execute the operations of the controller. The description herein including definers, determiners, evaluators, drivers, and/or regulators emphasizes the structural independence of certain aspects of the controllers 30, 36, and illustrates one grouping of operations and responsibilities of the controllers. Other groupings that execute similar overall operations are understood within the scope of the present application. Definers, determiners, evaluators, drivers, and/or regulators may be implemented in hardware and/or as computer instructions on a non-transient computer readable storage medium, and may be distributed across various hardware or computer based components.

Example and non-limiting implementation elements include sensors providing any value determined herein, sensors providing any value that is a precursor to a value determined herein, datalink and/or network hardware including communication chips, oscillating crystals, communication links, cables, twisted pair wiring, coaxial wiring, shielded wiring, transmitters, receivers, and/or transceivers, logic circuits, hard-wired logic circuits, reconfigurable logic circuits in a particular non-transient state configured according to a specification, any actuator including at least an electrical, hydraulic, or pneumatic actuator, a solenoid, an op-amp, analog control elements (springs, filters, integrators, adders, dividers, gain elements), and/or digital control elements.

Data structures may be provided to the controllers 30, 36 as sensor measurements, which may be physical measurements or virtual measurements. Virtual sensor measurements are determined or interpreted from sensor measurements and/or other data structures in the controllers 30, 36. In some cases, virtual sensor measurements are the output of a definer, determiner, driver, and/or regulator.

Controller 36 may include an engine parameter definer (not shown), an engine operation determiner 44 (e.g., engine controller and/or fuel system manager), and a fuel command driver 46 (e.g., fuel system driver). An engine parameter definer interprets one or more engine parameters, which makes them selectively available in the controller 36, such as an engine speed, an injector value, a cylinder value, a fueling command, and/or a pressure target for the HP fuel circuit 20. An engine operation determiner 44 determines a fuel flow target for the LP fuel circuit 18 in response to a pressure value for the HP fuel circuit 20 and optionally at least one of an engine speed, an injector value, a cylinder value, a fueling command, and a pressure target for the HP fuel circuit 20. An injector value includes a number of injectors. A cylinder value includes a number of cylinders. A fuel command driver 46 provides, to the eFTP 28, at least one of an operating mode command 40 and a pump command 42 in response to the fuel flow target to regulate a low-side fuel pressure.

In some embodiments, to perform the functions described herein throughout, the engine parameter definer may include, but is not limited to, a rotations per minute (RPM) sensor, an accelerator, a pressure sensor, a flow sensor, an analog to digital (ADC) converter or vice versa, a processor, a non-transient computer readable storage medium, computer readable instruction(s) stored on a non-transient computer readable storage medium, a bus, and/or wired/wireless connection hardware. In other embodiments, one or more of these may also be excluded from the engine parameter definer.

In various embodiments, to perform the functions described herein throughout, the engine operation determiner 44 may include, but is not limited to, an analog to digital (ADC) converter or vice versa, a processor, a non-transient computer readable storage medium, computer readable instruction(s) stored on a non-transient computer readable storage medium, a bus, and/or wired/wireless connection hardware. In other embodiments, one or more of these may also be excluded from the engine operation determiner 44.

Yet further, in some embodiments, to perform the functions described herein throughout, the fuel command driver 46 may include, but is not limited to, a fuel injector, a fuel control valve, an analog to digital (ADC) converter or vice versa, a processor, a non-transient computer readable storage medium, computer readable instruction(s) stored on a non-transient computer readable storage medium, a bus, and/or wired/wireless connection hardware. In other embodiments, one or more of these may also be excluded from the fuel command driver 46.

The eFTP 28 may include a fuel parameter definer (not shown) structured to interpret one or more fueling parameters including at least one of a low-side pressure target and a low-side pressure value, a pump operation determiner (not shown) structured to determine a regulated fuel flow value in response to the low-side pressure target and the low-side pressure value to regulate a pressure of the first fuel circuit, and a fuel flow regulator (not shown) structured to provide the fuel flow from the inlet to the outlet in response to the regulated fuel flow value.

In some embodiments, to perform the functions described herein throughout, the fuel parameter definer may include, but is not limited to, a pressure sensor, a flow sensor, an analog to digital (ADC) converter or vice versa, a processor, a non-transient computer readable storage medium, computer readable instruction(s) stored on a non-transient computer readable storage medium, a bus, and/or wired/wireless connection hardware. In other embodiments, one or more of these may also be excluded from the fuel parameter definer.

In various embodiments, to perform the functions described herein throughout, the pump operation determiner may include, but is not limited to, an analog to digital (ADC) converter or vice versa, a processor, a non-transient computer readable storage medium, computer readable instruction(s) stored on a non-transient computer readable storage medium, a bus, and/or wired/wireless connection hardware. In other embodiments, one or more of these may also be excluded from the pump operation determiner.

Yet further, in some embodiments, to perform the functions described herein throughout, the fuel flow regulator may include, but is not limited to, a pump, a valve, an analog to digital (ADC) converter or vice versa, a processor, a non-transient computer readable storage medium, computer readable instruction(s) stored on a non-transient computer readable storage medium, a bus, and/or wired/wireless connection hardware. In other embodiments, one or more of these may also be excluded from the fuel flow regulator.

Figure 2:
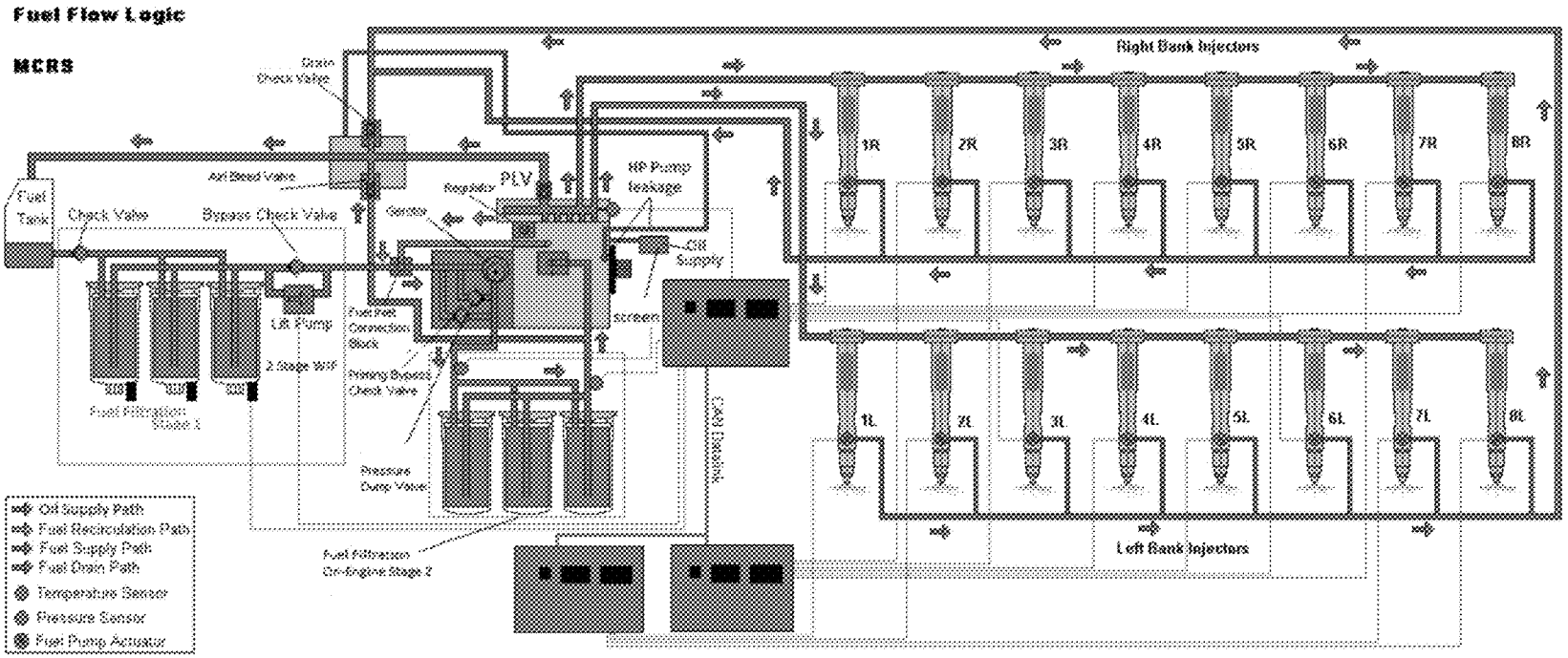
FIG. 2 is a schematic illustration of an example implementation of a conventional fuel system.

Referring now to FIG. 2, a prior-art fuel system includes a priming pump and a gerotor shown in the low-pressure fuel circuit along with a 2-stage pressure-responsive valve. Upon failure of a fuel control valve and/or a high-side sensor, the high-side pressure is controlled only by the engine speed and the 2-stage pressure-responsive valve, because the gerotor is proportionally driven proportional to engine speed (e.g., by the crankshaft). In response, the engine is severely derated in order to regulate pressure in the high-pressure fuel circuit. However, a decreased engine speed may not provide sufficient fuel in the low-pressure fuel circuit to keep the pressure-responsive valve open and evenly regulating the low-side pressure, and thus impacting the high-side pressure. In some embodiments, upon failure of the 2-stage pressure-responsive valve, the disturbances in low-side fuel pressure may result in unreliable high-side fuel pressure.

Figure 3:
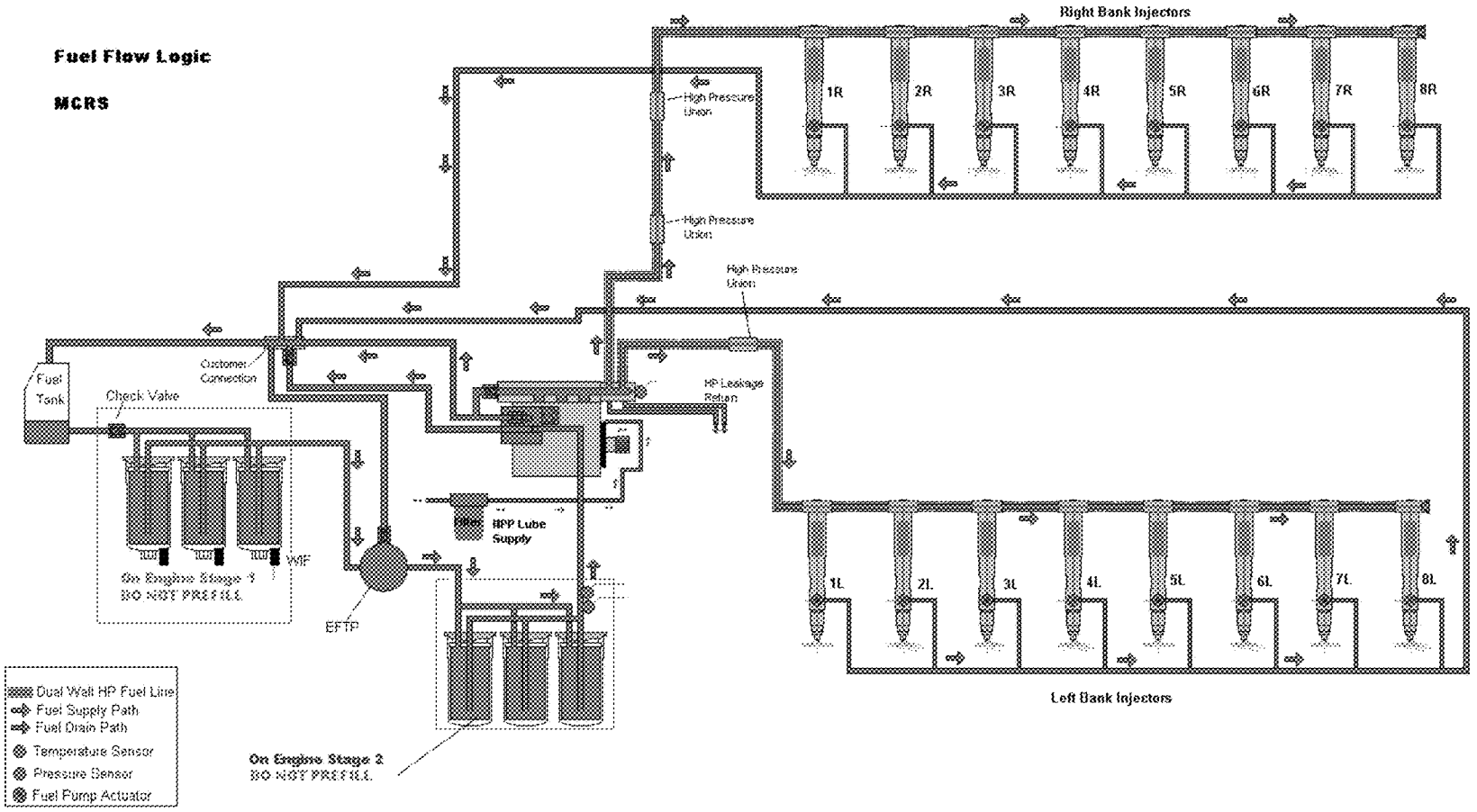
FIG. 3 is schematic illustration of an example implementation of the fuel system of FIG. 1, according to some embodiments.

In FIG. 3, an example implementation of the fuel system 10 is shown. A fuel tank provides fuel to a stage 1 filtration system. An eFTP pumps fuel at a low pressure from the stage 1 filtration system into a stage 2 filtration system and toward a fuel control valve upstream of a high-pressure fuel pump via a low-pressure fuel circuit. The fuel control valve opens and closes to allow the low-pressure fuel to enter the high-pressure pump. A 2-stage pressure-responsive valve is in fluid communication with the low-pressure fuel circuit configured to open above a threshold pressure and to regulate to a target pressure by bleeding excess pressure. The fuel entering the high-pressure pump is delivered to a plurality of fuel injectors via a high-pressure fuel circuit, which includes a high-pressure fuel rail.

Figure 4:
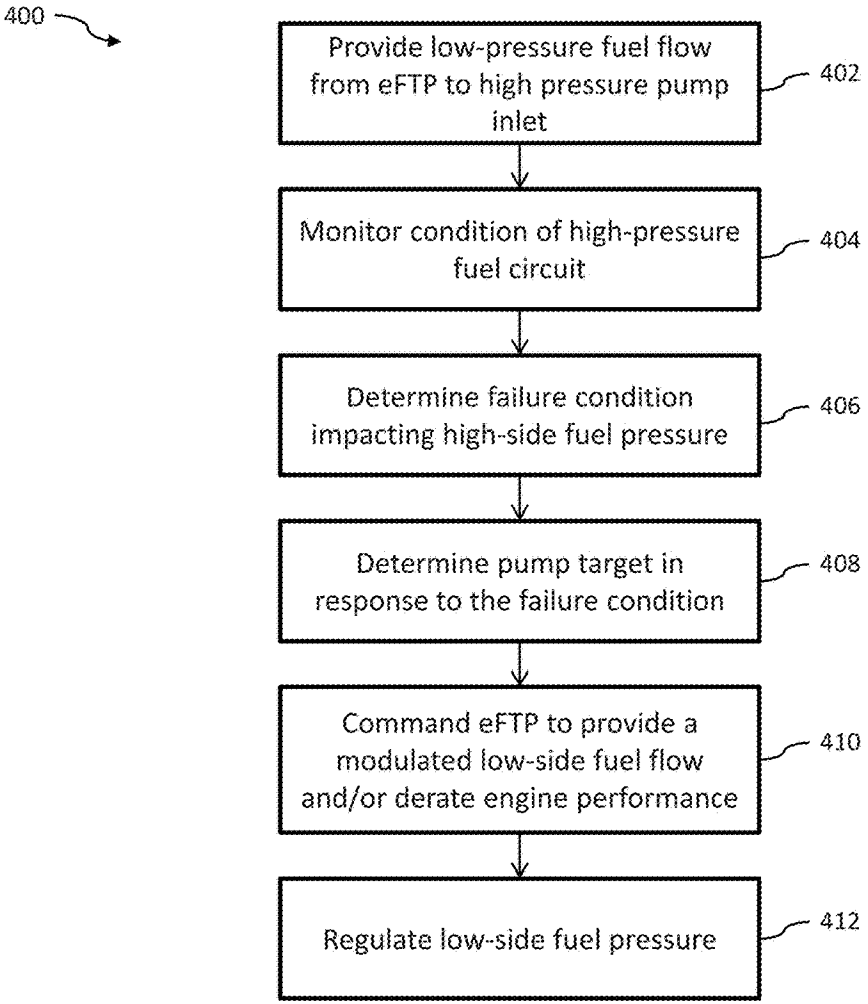
FIG. 4 is a flowchart of a process of operating the fuel system, according to some embodiments.

Referring to FIG. 4, a flowchart of a process 400 of operating a fuel system, such as fuel system 10, begins with operation 402, in which a low-pressure fuel flow is provided to the high-pressure pump, in particular from the eFTP 28 to the inlet of the high-pressure pump 22. In operation 404, a condition of the high-pressure fuel circuit 20 is monitored. In some embodiments, the condition is one of appropriate operation or a failure in the fuel system 10 impacting the high-side fuel pressure. In operation 406, a failure condition impacting the high-side fuel pressure is determined. Non-limiting examples of a failure condition includes the failure of a valve, a sensor, wiring, and/or other connections, any of which may impair the ability of the fuel system to regulate high-side fuel pressure.

In operation 408, a pump target is determined in response to the failure condition. In some embodiments, the pump target is determined in response to a measured high-side fuel pressure deviating from a target high-side fuel pressure. Such target high-side fuel pressure may be predetermined during calibration of the engine. In various embodiments, the pump target is determined in response to the inability to measure high-side fuel pressure. For example, a high-side pressure sensor may have malfunctioned. In such embodiments, the target low-side fuel flow may be selected in response to a predetermined low-side fuel flow in the event of sensor loss, for example. In additional or alternative embodiments, the target low-side fuel flow is determined in response to at least one of the engine speed, the number of injectors/cylinders, and/or the fueling command (e.g., how much fuel is to be delivered to the cylinder and optionally the associated timing and/or duration).

In operation 410, the eFTP 28 is commanded to provide a modulated low-side fuel flow in response to the target low-side fuel flow and/or engine performance is intentionally derated to protect engine components. For example, a pump command may be provided from controller 36 to the eFTP controller 30 with a target fuel flow, target pump speed, and/or target low-side fuel pressure. In various embodiments, the modulated low-side fuel flow and the derated engine performance are coordinated to reduce engine performance as necessary to mitigate damage to engine components while providing sufficient power to mitigate effects on the user experience due to derating.

In operation 412, the low-side fuel pressure is regulated. In various embodiments, the eFTP 28 is configured to regulate the low-side fuel pressure and provide the modulated low-side fuel flow as commanded. In this manner, the process 400 regulates the high-side fuel pressure to provide improved fuel delivery characteristics to the engine cylinders.

Figure 5:
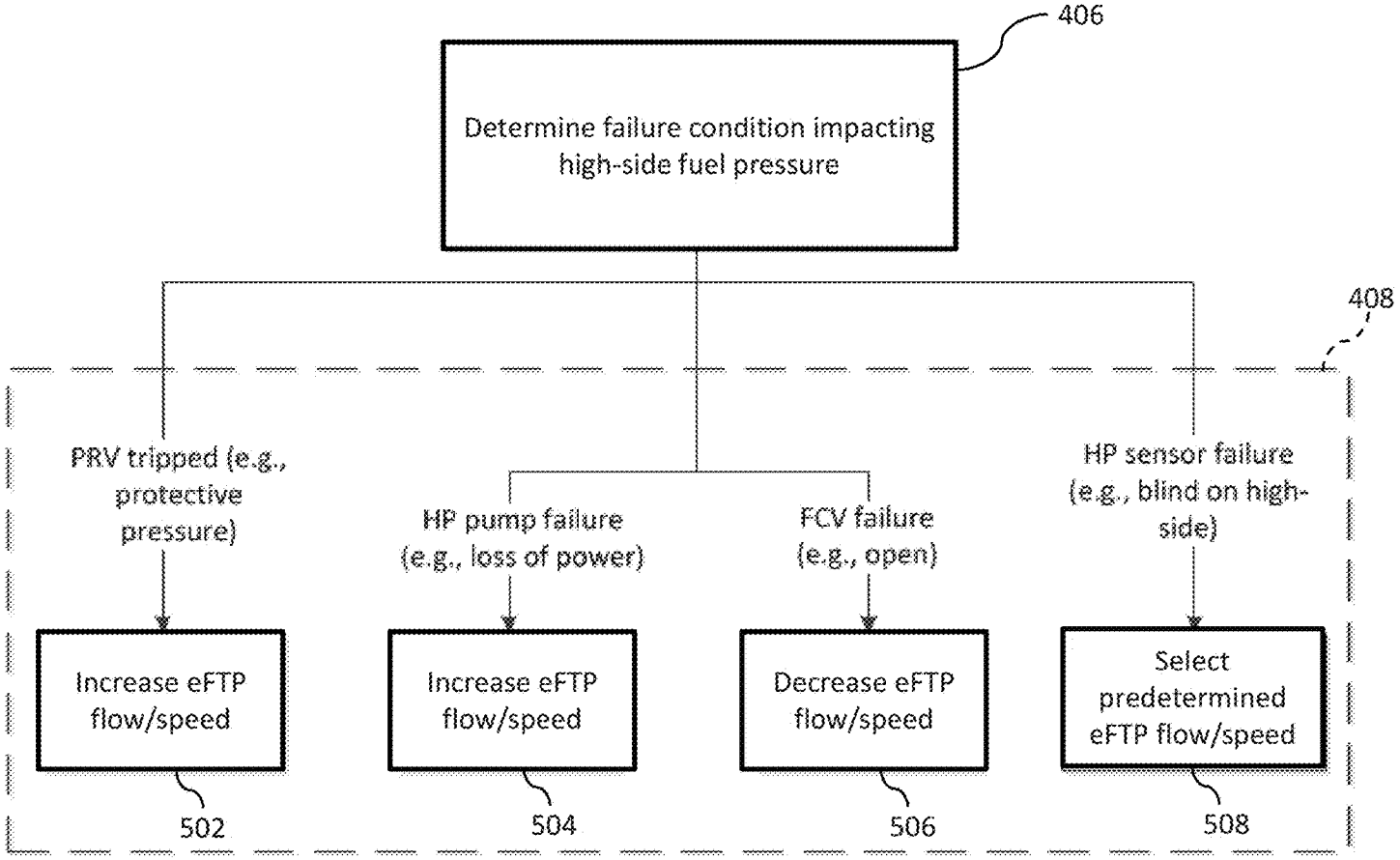
FIG. 5 is an expanded depiction of portions of the flowchart of FIG. 4, according to some embodiments.

Referring now to FIG. 5, an expanded depiction of operation 408 (determining a pump target) of FIG. 4 is shown. Other processes for determining a pump target are also contemplated. In the illustrated embodiment, after detecting a failure condition is impacting high-side fuel pressure in operation 406, a pump target is determined in response to the failure condition utilizing one or more of the operations 502, 504, 506 and 508. As used herein throughout, "increased" means a value greater than or higher than a nominal value utilized during nominal or failure-free engine operation and "reduced" means a value less than or lower than the nominal value.

In operation 502, in response to a PRV tripping and the high-side fuel pressure being regulated at a protective pressure, an increased eFTP flow, eFTP speed, and/or low-side fuel pressure is determined.

In operation 504, in response to an HP pump failure resulting in a loss of power and reduced high-side fuel pressure, an increased eFTP flow, eFTP speed, and/or low-side fuel pressure is determined.

In operation 506, in response to an FCV failure resulting in increased high-side fuel pressure (e.g., fail open), a reduced eFTP flow, eFTP speed, and/or low-side fuel pressure is determined.

In operation 508, in response to an HP sensor failure resulting in no available measurements of high-side fuel pressure (e.g., blind or no feedback operation), a predetermined eFTP flow, eFTP speed, and/or low-side fuel pressure is selected. The eFTP is operated in a feed forward manner with respect to high-side fuel pressure. The selected values may be predetermined during engine calibration, for example, and may be selected in response to one or more engine parameters other than high-side fuel pressure.

Any of operations 502, 504, 506, and 508 or combinations thereof may be performed to improve engine performance over conventional systems upon a failure of the fuel system impacting high-side fuel pressure, particularly when the engine performance is derated to protect engine components. User experience and engine damage mitigation are improved over conventional fuel systems.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for operating a fuel system of an internal combustion engine comprising:

providing a low-pressure (LP) fuel flow from an electronic fuel transfer pump to an inlet of a high-pressure (HP) pump fluidly coupled to an HP fuel circuit;

monitoring a condition of the HP fuel circuit;

detecting whether a failure condition is impacting a high-side fuel pressure;

determining an electronic fuel transfer pump target value in response to the failure condition;

commanding the electronic fuel transfer pump to provide a modulated LP fuel flow, the modulated LP fuel flow further achieved by controlling a fuel control valve positioned upstream from the HP pump; and regulating a low-side fuel pressure in response to the electronic fuel transfer pump target value.

2. The method of claim 1, wherein the failure condition includes at least one of: a press-responsive valve tripping, a failure of the HP pump, a failure of the fuel control valve, or a failure of a HP sensor.

3. The method of claim 2, wherein determining the electronic fuel transfer pump target value comprises at least one of:

in response to the pressure-responsive valve tripping, increasing at least one of: an electronic fuel transfer pump flow, an electronic fuel transfer pump speed, or the low-side fuel pressure;

in response to the failure of the HP pump resulting in a loss of power and reduced high-side fuel pressure, increasing at least one of: the electronic fuel transfer pump flow, the electronic fuel transfer pump speed, or the low-side fuel pressure;

in response to the failure of the fuel control valve resulting in increased high-side fuel pressure, reducing at least one of: the electronic fuel transfer pump flow, the electronic fuel transfer pump speed, or the low-side fuel pressure; and in response to the failure of the HP sensor resulting in no available measurements of the high-side fuel pressure, selecting at least one of: a predetermined electronic fuel transfer pump flow, a predetermined electronic fuel transfer pump speed, or a predetermined low-side fuel pressure.

4. The method of claim 1 further comprising reducing at least one of: engine torque or engine speed in response to at least one of: detecting the failure condition or determining that the modulated LP fuel flow or the electronic fuel transfer pump target value cannot support a demanded power output.

5. A fuel system for an internal combustion engine configured to supply fuel from a fuel source to a plurality of fuel injectors, comprising:

a low-pressure (LP) fuel circuit positioned upstream from a high-pressure (HP) fuel circuit and downstream from the fuel source along a fuel flow path;

a HP pump positioned along the fuel flow path downstream from the LP fuel circuit; and a controller operatively coupled to an electronic fuel transfer pump, one or more sensors along the fuel flow path, and a fuel control valve positioned upstream of the HP pump, wherein the one or more sensors comprise a high-side pressure sensor, the controller configured to:

provide at least one of: an operating mode command or a pump command to the electronic fuel transfer pump;

interpret a high-side pressure value in response to a measurement of the high-side pressure sensor, and at least two of: an engine speed, an injector value, a cylinder value including a number of cylinders, a fueling command, or a high-side pressure target; and determine a low-side fuel flow target in response to the high-side pressure value and the at least one of: the engine speed, the injector value, the cylinder value, the fueling command, or the high-side pressure target, wherein the electronic fuel transfer pump is in fluid communication with the LP fuel circuit and in operative communication with a low-side pressure sensor, and configured to:

receive the at least one of: the operating mode command or the pump command from the controller, the operating mode command comprising one of an ON command or an OFF command and the pump command comprising at least one of: a fuel flow command, a pump speed command, or a low-side fuel pressure command;

in response to receiving the operating mode command including the ON command, provide a LP fuel flow through the LP fuel circuit;

interpret a low-side pressure value in response to a measurement of the low-side pressure sensor; and in response to receiving the pump command, regulate at least one of: the low-side pressure or the low-side fuel flow of the LP fuel circuit toward at least one of: the low-side fuel flow target or a low-side pressure target provided by the pump command.

6. The fuel system of claim 5, wherein the controller is further configured to derate the internal combustion engine, wherein derating comprises reducing at least one of: engine torque or engine speed in response to the at least one of: the low-side pressure or the low-side fuel flow of the LP fuel circuit being incapable of being regulated toward the at least one of: the low-side fuel flow target or a low-side pressure target.

7. The fuel system of claim 5, wherein the controller is further configured to receive one or more diagnostic values, wherein the one or more diagnostic values comprise a pump diagnostic value.

8. The fuel system of claim 5, wherein the controller is further configured to monitor the condition of the high pressure fuel circuit over a period of time.

9. The fuel system of claim 5 further including a two-stage relief valve coupled to the HP fuel circuit, the two-stage relief valve configured to open at a tripping pressure to relieve excess pressure in a first stage and to remain open to regulate the high-side fuel pressure to a protective pressure in a second stage.

10. The fuel system of claim 9, wherein the tripping pressure is higher than a nominal high-side fuel pressure.

11. The fuel system of claim 9, wherein the protective pressure is lower than a nominal high-side fuel pressure.

12. The fuel system of claim 5, wherein the electronic fuel transfer pump, in response to receiving the pump command, regulates both the low-side pressure and the low-side fuel flow of the LP fuel circuit toward both the low-side fuel flow target and the low-side pressure target provided by the pump command.

13. The fuel system of claim 5, wherein the HP fuel circuit includes a HP fuel rail positioned between the HP pump and the plurality of fuel injectors along the fuel flow path.

14. The fuel system of claim 5, wherein the HP pump includes a fuel control valve, the HP pump being regulated by the fuel control valve and the electronic fuel transfer pump.

15. The fuel system of claim 14, wherein the fuel control valve is a primary actuator for regulation of fuel flow through the HP pump, and the electronic fuel transfer pump is a secondary actuator for regulation of fuel flow through the HP pump.

16. The fuel system of claim 5, wherein the electronic fuel transfer pump is further configured to communicate diagnostic data to a controller.

17. A controller for a fuel system having a first fuel circuit and a second fuel circuit, comprising:

an engine parameter definer configured to interpret one or more engine parameters;

an engine operation determiner configured to detect a failure condition associated with the second fuel circuit and determine a fuel flow target for the first fuel circuit in response to a pressure value for the second fuel circuit, the detected failure condition associated with at least two of: a press-responsive valve tripping, a failure of the HP pump, a failure of a fuel control valve positioned upstream from the HP pump, or a failure of a HP sensor; and a fuel command driver configured to provide, to a pump in operative communication with the controller, at least one of: an operating mode command or a pump command in response to the fuel flow target to regulate a pressure of the first fuel circuit.

18. The controller of claim 17, wherein the one or more engine parameters include at least one of: an engine speed, an injector value, a cylinder value, a fueling command, a pressure value for the second fuel circuit, or a pressure target for the second fuel circuit.

19. The controller of claim 17, wherein the fuel flow target for the LP fuel circuit is determined in response to the pressure value for the HP fuel circuit and at least one of: an engine speed, an injector value, a cylinder value, a fueling command, or a pressure target for the HP fuel circuit.

20. An electronic fuel transfer pump for a fuel system, comprising:

an inlet configured to couple to a fuel source;

an outlet for providing a fuel flow to a first fuel circuit;

a fuel parameter definer configured to interpret one or more fueling parameters;

a pump operation determiner configured to detect a failure condition associated with a second fuel circuit and determine a regulated fuel flow value in response to the one or more fueling parameters to regulate a pressure of the first fuel circuit, the detected failure condition associated with at least two of: a press-responsive valve tripping, a failure of the HP pump, a failure of a fuel control valve positioned upstream from the HP pump, or a failure of a HP sensor; and a fuel flow regulator configured to provide the fuel flow from the inlet to the outlet in response to the regulated fuel flow value.

21. The pump of claim 20, wherein the one or more fueling parameters include at least one of: a first pressure target or a first pressure value.

* * * * *